US005901470A

United States Patent [19]

Begey

[11] Patent Number: 5,901,470

[45] Date of Patent: May 11, 1999

[54] SPORTS BOOT

[75] Inventor: Jean-Marie Begey, Cranves Sales, France

[73] Assignee: Salomon S.A., Metz-Tessy, France

[21] Appl. No.: 08/902,257

[22] Filed: Jul. 29, 1997

[30] Foreign Application Priority Data

Aug. 6, 1996 [FR] France ..... 96 10097

[51] Int. Cl.[6] ..... A43B 5/00

[52] U.S. Cl. ..... 36/118.7; 36/118.8; 36/118.3; 36/118.2

[58] Field of Search ..... 36/118.7, 118.8, 36/119.1, 118.3, 118.2, 118.4, 118.5

[56] References Cited

U.S. PATENT DOCUMENTS

| | | | |
|---|---|---|---|
| 3,775,871 | 12/1973 | Serko | 36/2.5 AL |
| 4,899,469 | 2/1990 | Hilgarth | 36/118.8 |
| 4,910,888 | 3/1990 | Perrissoud | 36/117 |
| 5,001,849 | 3/1991 | Bidoia | 36/117 |
| 5,175,948 | 1/1993 | Tonel et al. | 36/118.3 |
| 5,353,528 | 10/1994 | Demarchi | 36/118.9 |
| 5,651,199 | 7/1997 | Chaigne et al. | 36/118.3 |

FOREIGN PATENT DOCUMENTS

| | | | |
|---|---|---|---|
| 0375604 | 6/1990 | European Pat. Off. . | |
| 578292 | 1/1994 | European Pat. Off. | 36/118.7 |
| 2619999 | 3/1989 | France . | |
| 2404447 | 8/1974 | Germany | 36/118.8 |
| 8020857 | 11/1980 | Germany . | |
| 3045928 | 9/1981 | Germany | 36/118.8 |

*Primary Examiner*—M. D. Patterson
*Attorney, Agent, or Firm*—Greenblum & Bernstein P.L.C.

[57] ABSTRACT

A sports boot with a rigid shell, having an upper that can be opened along the front and being connected via lateral journals to a shell base and that is blocked in its rearward pivoting by its lower edge that becomes supported along an edge of the shell base. A scalloping in the shape of an inverted "U" is provided in the lower edge of the upper in the extension of the dorsal zone thereof in order to weaken it at this spot and to reduce the bearing length of its lower edge along the edge of the shell base. At least one removable cam is capable of being actuated within the scalloping in order to stop any rearward elastic deformation of the upper.

17 Claims, 4 Drawing Sheets

SPORTS BOOT

BACKGROUND OF THE INVENTION

1. Field of the Invention

The present invention is related to sports boots known as "rigid shell" boots, having an upper, shaped like a tube and capable of being opened along the front, said upper being connected by lateral journals to a shell base, and capable of being stopped, during a rearward pivoting, by means of its lower bordering that takes support along an edge of the shell base, such edge extending between the journals of the upper, at least in the hell zone of the shell base.

2. Description of Background and Relevant Information

As illustrated in the examples of FIGS. 1 and 2, known sports boots of the aforementioned sort, such as ski boots, generally have an upper 1 shaped like a tube and are openable along the front, said upper being journaled 2, along the sides of a shell base 3, whose heel zone 4, at least, is provided with an edge 5 against which the lower bordering 6 of upper 1 takes support, and is thus stopped in its rearward pivoting. In there boots, among other things, the upper 1 that is openable along the front, constitutes the rear support means of the skier by virtue of its own stiffness and its rearward blocking, and thus enables the skier to control his front-to-rear balance, and the transmission of stresses in the direction of the tail of the ski. In order to ensure that the quality of the rear support provided is in harmony with the technical ability of the skier and the type of skiing being envisioned, i.e., competitive skiing or leisure skiing, the upper 1 of these boots, and especially the dorsal zone 7 thereof, is kept relatively non-deformable and stiff, as has been illustrated in FIG. 1, or instead, is capable of getting elastically deformed, as has been illustrated in FIG. 2. Indeed, it can be noted that when the issue at hand is competitive skiing where speeds are high and the course trajectory is predetermined, the skier must perceive the smallest variations in his supports almost instantaneously in order to react appropriately, and that only a rigid upper that can be blocked towards the rear on the shell base can, on the one hand, render detectable and amplify small variations, and on the other hand, transmit the impulses without any loss of force and within a short space of time. In comparison, when the issue at hand is leisure skiing where speeds are slower than in competitions, an where the there are no course-related limitations because the skier is free to select his own path, a less rigid upper, even one that is capable of being elastically deformed, proves to be well adapted, so that the skier perceives the variations of his supports on the upper in a timely manner and can react as a consequence thereto.

As such, in the example of the boot illustrated in FIG. 1, the upper 1 is shaped like a tube, openable along the front with a dorsal zone 7 all in one piece, so that its very shape provides substantial vertical rearward stiffness. This vertical stiffness is repeated at the level of the heel 4 of the shell base 3 by means of an edge 5, across from which can be found the lower edge or border 6 of said upper 1, extending substantially to the journals 2 of the latter. The various stiff or substantially resistant components of the boots are thus perfectly adjusted and blocked in any rearward pivoting, and are thus capable of transmitting the rear supports of the skier in the heel zone 4 without any loss of force and almost instantaneously. Consequently, such boots prove to be very precise and are relatively well suited for the practice of competitive skiing; however, they require that great caution be taken by the skier, and demand a certain level of technical ability from him. In fact, since variations in support are transmitted almost instantaneously to the skis and vice-versa, and the skis react as a result of these stresses, the skier is obliged to maintain extreme caution, and therefore cannot let himself go and/or adopt a more relaxed style. In fact, he finds himself in a situation that is closer to competitive skiing than leisure skiing. If, for instance, the skier's technical abilities are inadequate or he lacks speed, substantial stiffness of the upper constitutes a disadvantage to him because it tends to heighten his front-to-rear balancing defects.

Further, known boots of this type, openable along the front, are lacking in all adjustment means that could modify the stress towards the rear of their uppers. As such, the skier who wants to switch from a competition-like sports mode to a more relaxed, leisurely mode, is practically obliged to change boots and to choose boots that are less stiff. As an example, the boot of FIG. 2, which represents the "LOTUS" model that was marketed in 1979 under the RAICHLE brand name, is an illustration of a boot that is capable of providing a certain dampening of the rearward supports of the skier. In this boot, the upper 1 is equipped with a transverse slit 8 that extends from its dorsal zone 7 to its lateral journals 2. Thus, when the bottom part of the skier's leg takes rearward support, the dorsal zone 7 of upper 1 that is above slit 8, bends via elastic deformation by pivoting about its lateral journals 2 along with the lower part of the skier's leg. Consequently, the localization of over-pressure at the level of the upper bordering of upper 1 is avoided, and a portion of the stresses produced by the skier is absorbed by the rearward bending of the upper, which reduces the firmness of its support by that amount.

These types of boots that are openable along the front and have a shock absorbing upper are, therefore, well-suited to leisure skiing. However, a particular disadvantage lies in the fact that are confined to this area alone or, in other words, they have an upper that is non-adjustable or modifiable in rearward stiffness, as was the case in the previous example of boots that were openable along the front but were confined to the arena of competitive skiing.

SUMMARY OF THE INVENTION

It is an object of the instant invention to overcome the aforementioned disadvantages of rigid shell boots whose upper can be opened along the front, in a simple and efficient manner by allowing the wearer to modify the initial predetermined stiffness of the upper in the front-to-rear direction in order to obtain a firmer support, and wherein this action can also be reversed. Indeed, an aim of the invention is to allow the wearer to adapt the rearward stiffness of the boot in accordance with his technical abilities and the type of sport he intends to practice.

To this end, the rigid shell sports boot comprises an upper shaped like a tube that can be opened along the front and that has a dorsal zone all in one piece. The upper is connected via lateral journals to a shell base and is blocked in rearward pivoting by means of its lower bordering which takes support on the edge of the shell base, such edge extending between the journals of the upper in the heel zone of the shell base. The lower bordering of the upper displays a scalloping in the shape of a inverted "U" which extends into the extension of the dorsal zone of the upper, and goes around the heel zone and a part of the sides of the shell base, so as to determine the reduced lateral bearing areas taking support on the edge of the shell base that extends from one side to the other thereof by going around the heel zone. The intent of this scalloping is to weaken the upper in its lower dorsal zone and to reduce the bearing length of its lower bordering along the edge of the shell base of the heel up to the sides thereof, and in the direction of its journals, thus leaving only reduced lateral bearing areas. The upper obtained in this manner has, in a predetermined manner, a certain ability to be elastically deformed towards the rear, i.e., the initial stiffness is weak, and this is a desirable characteristic in the practice of leisure skiing.

According to another characteristic, at least one removable cam is capable, in a first position, of being placed inside the scalloping shaped liked an inverted "U" in order to constitute an abutment between the latter and the edge of the shell base, thus stopping any rearward elastic deformation of the upper stiffened in this manner. In a second position, the removable cam can be retracted, thus leaving the interior of the scalloping free, and restoring the initial stiffness to the upper, or in other words, restoring its predetermined elastic deformation ability. One can, by virtue of this characteristic, modify the initial stiffness of the upper of the boot in front-to-rear direction at will, and thus adapt the boot to the particular sport being envisaged, for example, very technical and dynamic as in the case of competitive skiing, or more leisurely and relaxed, as in the case of leisure skiing.

According to a preferred embodiment, provision is made for two removable cams to be actuated within the scalloping shaped like an inverted "U". These cams are located on either side thereof, at the level of the dorsal zone of the upper, and each of them is coordinated with the edge of the shell base, between the heel zone of latter and the corresponding side. This arrangement makes it possible to only place one cam in an abutment position, and thus to modulate the lateral stiffness of the upper by favoring the inner or outer side, simultaneously with the stiffening of its dorsal zone in rear support.

According to a particular detail, the removable cam or cams are rotational cams, preferably mounted on rotational shafts that are equipped with a handling means, such as a screwdriver slot or a button.

According to another detail, the removable cam or cams can be borne either by the upper or by the shell base, without it making a difference, and they comprise a latching and/or stop means adapted to maintain them in their first abutment position and/or in their second retracted position.

BRIEF DESCRIPTION OF THE DRAWINGS

The invention will be better understood, and other characteristics and advantages of the invention will become apparent, in light of the description that follows and in reference to the annexed drawings which include examples of the invention, wherein.

DETAILED DESCRIPTION

Figure 1:
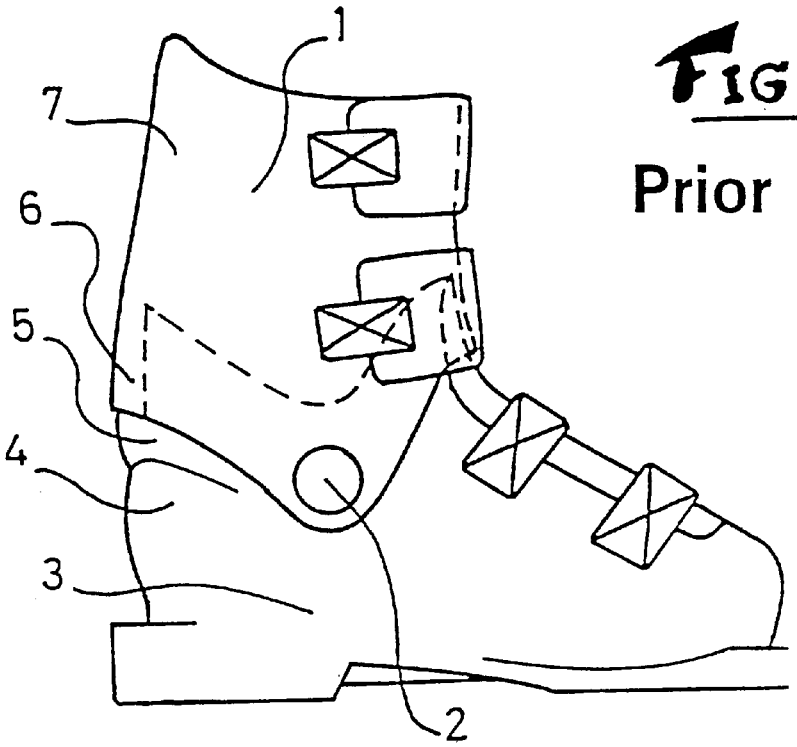
FIG 1 Prior Art
FIGS. 1 and 2 illustrate prior art boots, as described above.
Figure 2:
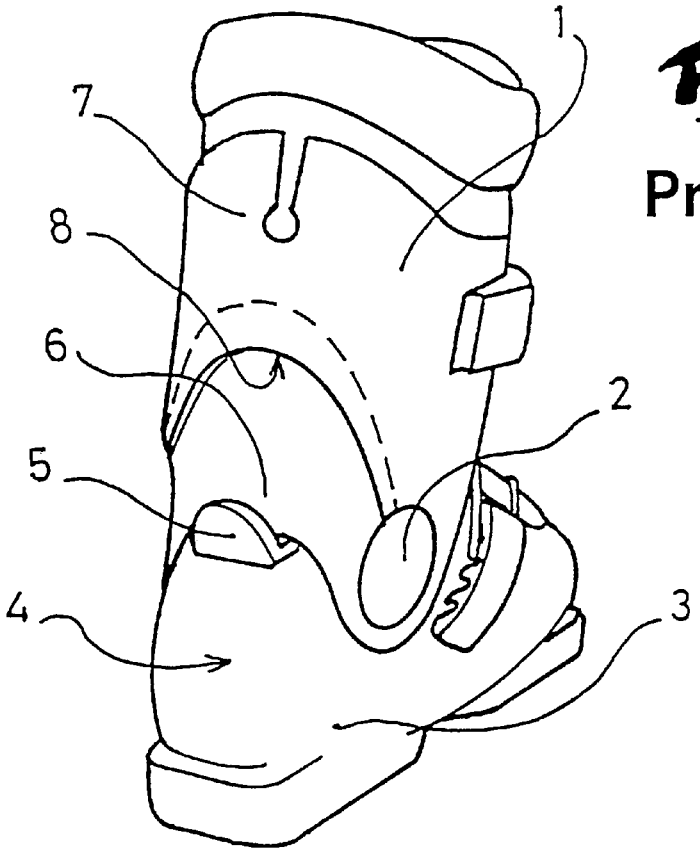
FIG 2 Prior Art
Figure 3:
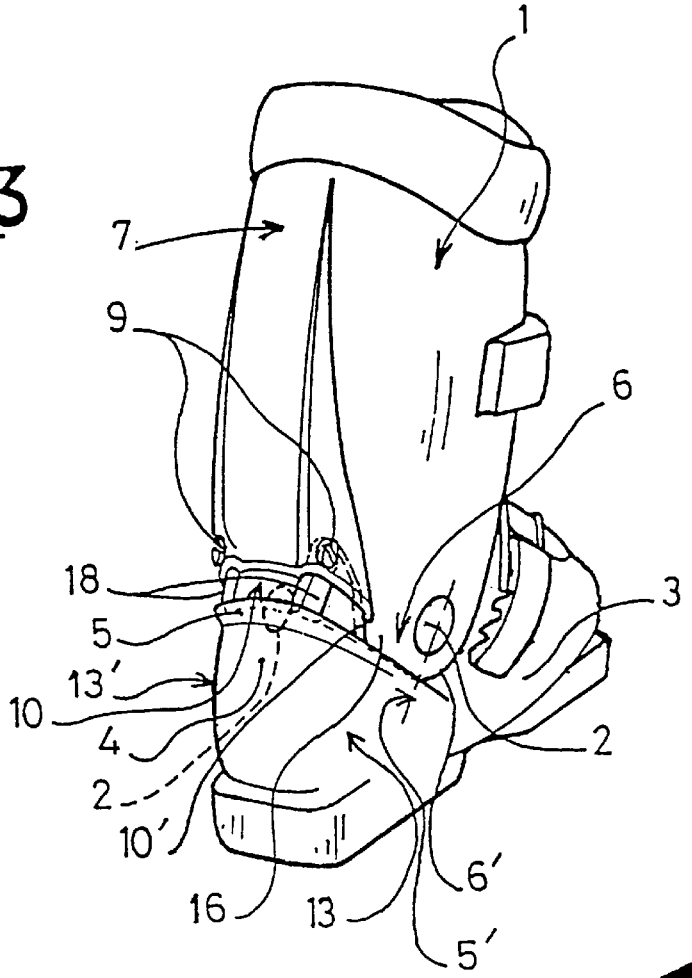
FIG. 3 is a rear perspective view of a ski boot equipped with an upper whose stiffness can be adjusted, according to the invention.
Figure 4:
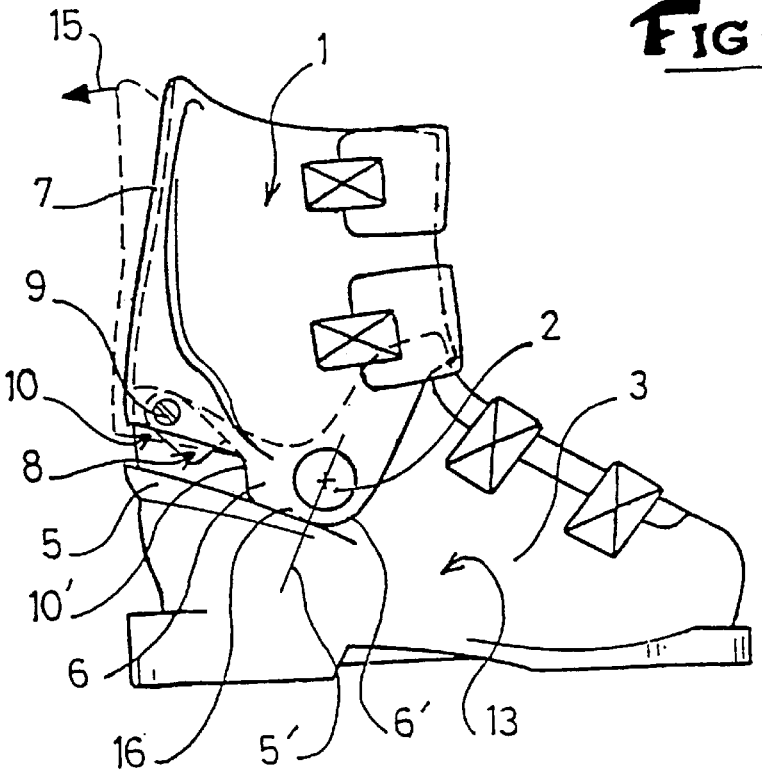
FIGS. 4 and 5 illustrate the boot of FIG. 3, FIG. 4 showing the boot with its upper in a position of minimum stiffness, and FIG. 5 showing the boot with its upper in a position of maximum stiffness.
Figure 5:
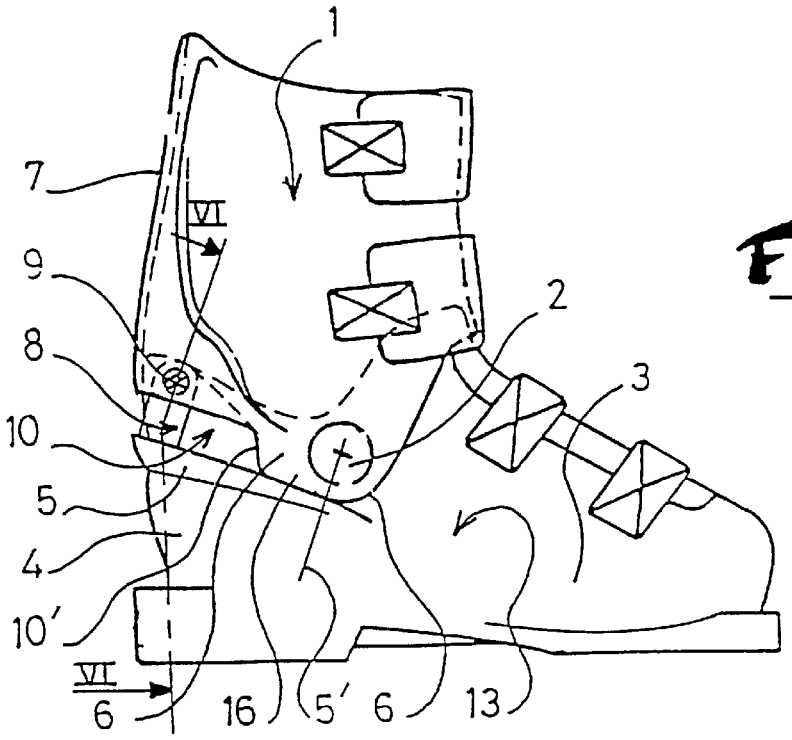

The boot represented in FIGS. 3, 4, and 5 comprises an upper 1 shaped like a tube and openable along the front, having a dorsal zone 7 all in one piece i.e., the boot includes a unitary front-entry tubular upper 1, having a rear portion 7. The upper 1 is connected to a shell base 3 via lateral journals 2 and is blocked in its rearward pivoting by means of its lower edge or border 6 that takes support along an edge 5 of the sell base 3. This edge 5 extends continuously from one side 13 to the other 13' of shell base 3 by going around heel zone 4, at least from the journals 2 of upper 1 whose lower border 6 is obtained with a rounded front portion 6'. The upper can thus bend towards the front without being hindered or impaired in its movement by the border 5 of shell base 3 which is tangential to the rounded portion 6'.

A scalloping 10 shaped like an inverted "U" is provided in the lower edge 6 of upper 1 in the extension of the dorsal zone 7 of the latter and extends laterally via its edges 10' at least partially along the sides 13, 13' of the shell base 3. Due to is fact, the upper 1 no longer take rear support on the edge 5 of shell base 3 except by the reduced lateral bearing areas 16 of its lower edge 6 that remain between the edges 10' of the scalloping 10 and the perpendicular 5' at the tangent point of said edge 5 with the rounded front portion 6' of its edge 6, as has especially been illustrated in FIG. 7. The upper 1 thus finds itself weakened in its dorsal zone 7 and tends to bend elastically towards the rear when a force in this direction is applied on it.

Figure 6:
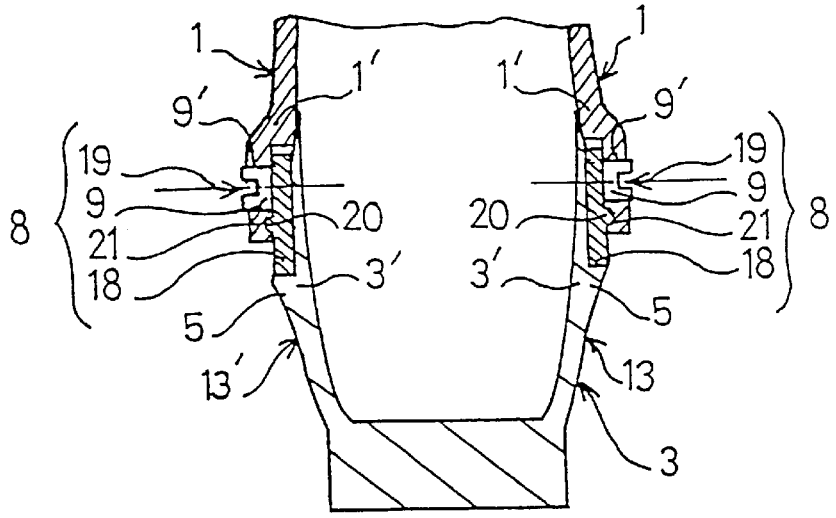
FIG. 6 is a sectional view of the boot of FIG. 3, taken along the line VI—VI.
Figure 7:
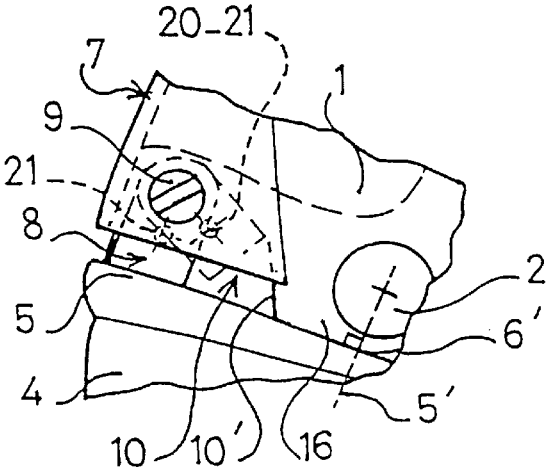
FIG. 7 illustrates a detail of the boot.

Along with the scalloping 10, shaped like an inverted "U", two removable cams 8, pivotably mounted on rotational shafts 9, are located on upper 1, approximately on either side of the dorsal zone 7 the so that each is able to cooperate with the edge 5 of shell base 3 between the heel zone 4 and the sides 13, 13' corresponding to the latter. Provision is made for these cams to be actuated within the scalloping 10 in an initial position illustrated in FIGS. 3, 5, 6 and 7, wherein they come into abutment against the edge 5 of shell base 3, and also in a second position, as illustrated in FIGS. 4 and 7 in dotted and dashed lines, wherein they are retracted away from said edge 5. To this end, as is illustrated in detail in FIGS. 6 and 7, each of the removable cams is provided with an excentered arm 18, a handling mechanism such as a screwdriver slot 19 provided on shaft 9, and a stopping mechanism for each actuated position, such as a bump 20 adapted to cooperate, via elastic latching, with a corresponding hollow 21. Advantageously, the affixation of the removable cams 8 relative to the upper 1 is obtained by the "sandwich" grip of their excentered arm between the walls 1' and 3' of the upper 1 and the shell base 3 and by the nesting of their rotational shaft 9 that crosses the wall of the upper 1 via a corresponding hole 9', and this is done when the upper 1 is assembled on the shell base 3 by means of journal axes 2.

These arrangements ensure that if one wants to practice leisure skiing, the interior of the scalloping 10 can be left free by retracting the excentered arms 9 of the cams 8 therefrom, the cam thus being withdrawn with respect to the edge 5 as is represented in FIG. 4. In this position of the removable cams 8, the upper 1 is thus capable of bending elastically towards the rear, in the direction indicated by the arrow 15, and from the lateral bearing areas 16 of its lower edge 6 that are in abutment an 5. Conversely, if one wants to ski competitively for example, the removable cams 8 can be pushed inside the casing 10 in such a way that the ends of their excentered arms 18 come into support on the edge 5 of shell base 3, as has been illustrated in FIGS. 3, 5, 6, and 7. In this other position, the removable cams 8 each constitute an abutment that becomes interspersed between the dorsal zone 7 of upper 1 and the edge 5 of shell base 3, and resists the elastic deformation upper 1 in a rearward direction.

As has been clearly shown, in this construction of the invention where there is a removable cam 8 located on either side of the dorsal zone 7 of the upper, it is possible to only place one cam 8 in the abutment position, and the other is kept retracted. In this implementation example, the upper 1 is cable of only bending in a side-to-rear direction directed towards to that side of the boot where the removable cam 8 is retracted. This means that the front-to-rear stiffness can be increased in the dorsal zone of upper 1 by favoring one side of the boot.

It is to be understood that the invention can be applied to other boots having rigid shells, such as ice skates, roller skates, and others, and that it may comprise only one removable cam, preferably mounted in the median portion of the dorsal zone 7 of upper 1.

Figure 8:
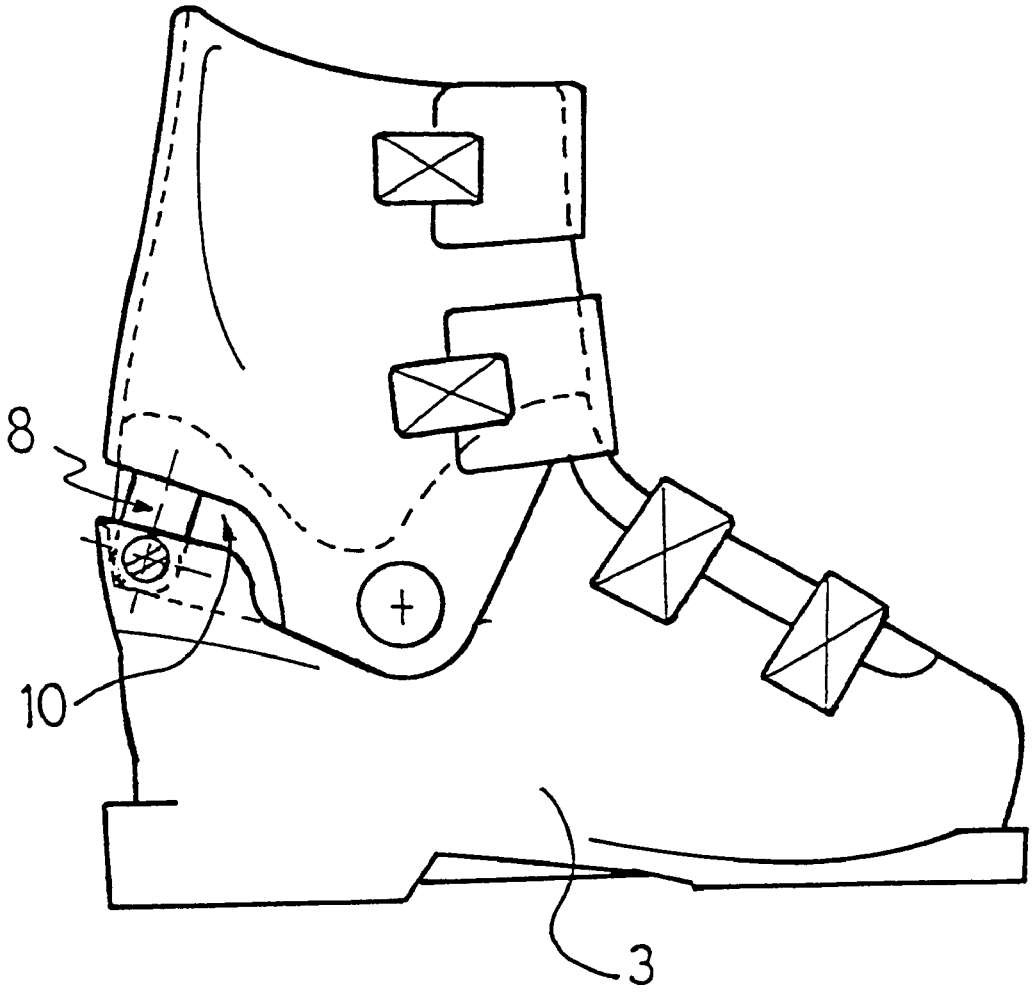
FIG. 8 illustrates a boot according to an alternative embodiment.

In addition, as illustrated in FIG. 8, the removable cams 8 can be mounted and fixed on the shell base 3, and in the abutment position, they can take support on the base of the scalloping 10, without in any way exceeding the scope of the invention.

The instant application is based upon the French priority patent application No. 96,10097 filed on Aug. 6, 1996, the disclosure of which is hereby expressly incorporated by reference thereto, and the priority of which is hereby claimed under 35 USC 119.

What is claimed is:

1. A sports boot comprising:

a shell base having opposite lateral sides connected by a heel zone;

a tubular upper having a front opening and a rear zone;

lateral journals connecting said upper to said shell base;

said shell base having an edge extending between said lateral journals at least around said heel zone of said shell base and extending along at least respective portions of said sides of said shell base;

said upper having a lower edge extending at least along said rear zone of said upper between said lateral journals, said lower edge of said upper defining an inverted U-shaped scalloping extending around said heel zone of said shell base and extending along at least respective portions of said sides of said shell base and forming reduced lateral bearing areas, laterally spaced apart by said scalloping, said reduced lateral bearing areas of said upper being in engagement with said edge of said shell base in a rearward blocked position of said upper.

2. A sports boot according to claim 1, further comprising:

at least one movable cam and a connection between said cam and one of said upper and said shell base, said connection mounting said cam for selective positioning between an abutment position, in which said cam extends within said scalloping and constitutes an abutment between said upper and said shell base, and a retracted non-abutment position.

3. A sports boot according to claim 2, wherein:

said connection mounts said cam on said upper and, in said abutment position, said cam is in abutment with said edge of said shell base.

4. A sports boot according to claim 2, wherein:

said connection mounts said cam on said shell base and, in said abutment position, said cam is in abutment with said lower edge of said upper within said scalloping.

5. A sports boot according to claim 2, wherein:

said connection for said cam comprises a pivotal mounting of said cam on a rotational shaft including a handling mechanism to facilitate said selective positioning of said cam.

6. A sports boot according to claim 5, wherein:

said handling mechanism comprises a slot on an end of said shaft for engagement with a screwdriver.

7. A sports boot according to claim 2, wherein:

said cam includes a stop mechanism to maintain said cam in said abutment position and in said non-abutment position.

8. A sports boot according to claim 7, wherein:

said stop mechanism comprises a bump and hollow, one of said bump and hollow being on said cam and another of said bump and hollow being on another part of said boot.

9. A sports boot according to claim 2, wherein:

said at least one movable cam comprises two movable cams, located on respective opposite sides of said rear zone of said upper, and respective connections between said two cams and one of said upper and said shell base for selective positioning of said cams between said abutment position and said non-abutment position.

10. A sports boot according to claim 9, wherein:

at least one of said movable cams is mounted, by means of a respective one of said connections, on said upper and, in said abutment position, in abutment with said edge of said shell base.

11. A sports boot according to claim 9, wherein:

at least one of said movable cams is mounted, by means of a respective one of said connections, on said shell base and, in said abutment position, in abutment with said lower edge of said upper within said scalloping.

12. A sports boot according to claim 9, wherein:

said connections mount said two cams on said upper and, in said abutment position, said cams are in abutment with said edge of said shell base.

13. A sports boot according to claim 9, wherein:

said connections mount said two cams on said shell base and, in said abutment position, said cam is in abutment with said lower edge of said upper within said scalloping.

14. A sports boot according to claim 9, wherein:

each of said connections for said cams comprises a pivotal mounting of a respective cam on a rotational shaft including a handling mechanism to facilitate said selective positioning of said cam.

15. A sports boot according to claim 9, wherein:

each of said handling mechanisms comprises a slot on an end of said shaft for engagement with a screwdriver.

16. A sports boot according to claim 9, wherein:

each of said cams includes a stop mechanism to maintain a respective cam in said abutment position and in said non-abutment position.

17. A sports boot according to claim 16, wherein:

each of said stop mechanisms comprises a bump and hollow, one of said bump and hollow being on said respective cam and another of said bump and hollow being on another part of said boot.

* * * * *